US007097114B2

(12) United States Patent
Aradi

(10) Patent No.: US 7,097,114 B2
(45) Date of Patent: Aug. 29, 2006

(54) FUEL INJECTOR ADAPTED TO REMOVE DEPOSITS BY SONIC SHOCK

(75) Inventor: Allen A. Aradi, Richmond, VA (US)

(73) Assignee: Afton Chemical Corporation, Richmond, VA (US)

( * ) Notice: Subject to any disclaimer, the term of this patent is extended or adjusted under 35 U.S.C. 154(b) by 147 days.

(21) Appl. No.: 10/981,106

(22) Filed: Nov. 4, 2004

(65) Prior Publication Data

US 2006/0091239 A1 May 4, 2006

(51) Int. Cl.

| | |
|---|---|
| ***F02M 47/02*** | (2006.01) |
| ***F02M 59/00*** | (2006.01) |
| ***F02M 39/00*** | (2006.01) |
| ***B05B 1/30*** | (2006.01) |

(52) U.S. Cl. ..... 239/88; 239/89; 239/90; 239/91; 239/92; 239/533.2; 239/533.4; 239/585.1; 239/585.2; 239/585.3; 239/585.4; 239/585.5; 239/5; 239/104

(58) Field of Classification Search ..... 239/88–92, 239/533.2, 533.4, 585.1–585.5, 104, 106, 239/5; 251/129.15, 129.21, 127
See application file for complete search history.

(56) References Cited

U.S. PATENT DOCUMENTS 3,552,370 A 1/1971 Briggs
4,203,393 A * 5/1980 Giardini ..... 123/260
5,237,967 A 8/1993 Willermet et al.
5,249,554 A 10/1993 Tamor et al.
5,309,874 A 5/1994 Willermet et al.
6,334,434 B1 1/2002 Imoehl et al.

OTHER PUBLICATIONS

Gautam T. Kalghatgi, Deposits in Gasoline Engines—A Literature Review, Paper No. 902105, pp. 639-667, Shell Research Ltd., Thornton Research Centre, Chester, UK.

Allen A. Aradi (Ethyl Corporation); Bill Imoehl (Siemens Automotive Corporation); and Noyes L. Avery, Paul P. Wells, & Richard W. Grosser (Mobil Technology Company), "The Effect of fuel Composition and Engine Operating Parameters on Injector Deposits in High-Pressure Direct Injection Gasoline (DIG) Research Engine," Society of Automotive Engineers, Inc. (SAE) Paper No. 1999-01-3690, pp. 1-9.

* cited by examiner

*Primary Examiner*—Davis Hwu
(74) *Attorney, Agent, or Firm*—Dennis H. Rainear

(57) ABSTRACT

The present disclosure provides a self-cleaning injector nozzle or other fluid conduit that maintains deposits at a low level by sonic tuning the shock wave generated during fluid flow through that nozzle or conduit. Methods of producing an injector nozzle and a method of cleansing deposits from liquid or gaseous fluids are also disclosed.

20 Claims, 2 Drawing Sheets

FUEL INJECTOR ADAPTED TO REMOVE DEPOSITS BY SONIC SHOCK

TECHNICAL FIELD

The present disclosure relates in one embodiment to a liquid or gaseous fluid conduit that is adapted to cleanse itself of deposits from the liquid or gaseous fluid as they accumulate in the conduit. This may be used as liquid or gaseous fuel injector nozzles such as those used in internal combustion engines. The device of the present disclosure may also be used in other liquid or gaseous fluid conduits that are subject to deposition from the conducted liquid or gas that are carried at or near hypersonic velocities.

BACKGROUND AND DESCRIPTION OF THE RELATED ARTS

Injector coking is a serious problem in direct injected internal combustion engines, because the injectors are in contact with the harsh environment of the combustion chamber. Because of the high temperatures, fuel decomposes in the injector nozzle and lays down a deposit which both restricts flow, and distorts the symmetry of the spray. As this deposit grows with operation, the internal dimensions of the nozzle change.

The buildup of deposits in the combustion chamber can alter engine performance by impairing fuel economy, regulated emissions, and driveability, and in the worst case scenario causing engine damage. A detailed account of such deposits, problems and some attempted solutions can be found in S.A.E. Technical Paper No. 902105 (1990) by G. T. Kalghatgi. Carbonaceous deposits are especially problematic for fuel injectors located within the engine combustion chamber. Direct injection spark ignition (DISI) engines include a fuel injector injecting fuel directly into the combustion chamber.

If the fuel injector could be made to resist the carbonaceous deposits, existing fuels and fuel injector designs could be utilized. In the past, components have been coated with amorphous hydrogenated carbon to increase hardness and durability, decrease friction and wear and protect against corrosion. As described in U.S. Pat. Nos. 5,249,554, 5,309,874, and 5,237,967 assigned to Ford Motor Company, and incorporated herein by reference, power train components have been coated with such carbon film coatings to reduce friction and wear related thereto. More recently, coatings have also been applied in an effort to reduce deposit formation. One example is U.S. Pat. No. 3,552,370, issued to Briggs et al, which describes a coating, and method of application, including the constituents of nickel, aluminum and copper for the purpose of reducing heat transfer from the combustion chamber to foster a more complete combustion.

Fuel additives alone typically are ineffective once fuel injectors have become fouled with substantial amounts of deposits such that the ability of the additive package to cleanse the injector is overcome.

Accordingly, there remains a need for fuel injectors that are capable of reducing and preventing the growth of carbonaceous deposits, especially so as to be able to keep deposits at a sufficiently low level that they may effectively be held at operable levels by fuel additives.

SUMMARY

Accordingly, one embodiment herein provides a method to prevent the formation of carbonaceous deposits in fuel injectors. Another embodiment provides a self-cleaning injector nozzle or other fluid conduit that maintains deposits at a low level by sonic tuning the shock wave generated during fluid flow through that nozzle or conduit.

It has been presently found that the sonic shock wave frequency set up by the fluid flowing through the nozzle also changes as the nozzle cokes. Surprisingly, this change can lead to a frequency regime within which a deposit cleaning mechanism is initiated. The present disclosure makes use of this principle to design injector nozzles of appropriate internal dimensions that set up the appropriate sonic shock wave frequency for self cleaning as soon as the deposit begins to form.

Thus, in another embodiment, a method is disclosed for providing an injector that is designed to provide a precursor surface which, when coated with a deposit, forms a surface that cooperates with the flowing fluid to provide sufficient sonic shock to dislodge the deposit.

The present disclosure may be utilized in any hydraulic or pneumatic-driven liquid and gas injectors operating in conditions that promote decomposition in the nozzle of the fluid being injected, leading to a flow altering deposit build up. This includes injectors used in fuel direct injection (DI) compression-ignited (CI) and spark-ignited (SI) engines. The present disclosure provides fuel injectors that maintain optimal fuel economy and fuel optimization. Examples of such fuel injector nozzles include those described in U.S. Pat. No. 6,334,434 B1, incorporated herein by reference.

Although described in the context of fuel injector nozzles, the present disclosure may also be advantageously applied to other liquid and gaseous fluid conduits that are likewise subject to deposition at or near hypersonic speeds where cavitation and the attendant sonic shock may be used to remove deposits from the interior conduit surfaces subject to deposition.

In general terms, one embodiment herein includes an injector nozzle as part of a fuel injector device that in turn is a part of an engine.

Another embodiment includes an injector nozzle for an internal combustion engine having anti-deposit characteristics, the injector nozzle comprising: (a) an injector nozzle seat portion and needle adapted to fit against the seat and adapted to be moved between a closed position against the seat and an open position away from contact with the seat; (b) an injector nozzle pipe portion having an entrance, an inside diameter at the entrance, an interior surface, and a degree of taper; the injector nozzle having an injector nozzle seat portion and needle of such dimensions, an inside diameter at the entrance, and a degree of taper such that, when fuel is passed through the injector nozzle during operation of the internal combustion engine, a sonic shock wave is created within the injector nozzle pipe portion, and as deposits from the fuel begin to develop on the interior surface of the injector nozzle pipe portion during the operation, the frequency of the sonic shock wave frequency changes from a first frequency at which the sonic shock wave does not cause the deposits to be removed, to a second frequency at which the sonic shock wave causes the deposits to be removed and/or not deposited.

Preferably, the rate at which the deposits are removed upon the shock wave reaching the second frequency is at least equal to the rate at which the deposits are deposited.

The injector nozzle seat portion may be made so as to taper from a diameter greater than the inside diameter at the entrance of injector nozzle pipe to a diameter greater than or equal to the inside diameter at the entrance of injector nozzle pipe.

The injector nozzle seat portion may comprise a curved portion with the needle also comprising a sealing portion of even greater curvature, such that the curved portions adapted to engage one another intimately when the needle moves to the closed position. Alternatively, the injector nozzle seat portion may comprise a flat portion with the needle comprising a curved portion, such that the flat portion and the curved portion are adapted to engage one another when the needle moves to the closed position.

The injector nozzle may be made so as to have its interior surface of the injector nozzle pipe portion comprise furrows aligned orthogonal to the direction of flow of the fuel during the operation, and/or dimple-shaped protrusions, that are designed to prove a precursor surface of such geometry that the geometry of the surface with the initial deposits from the liquid or gaseous fluid from a surface that gives rise to sonic shock of such magnitude that the deposits are removed. The precursor shaping may be made by known milling techniques or through the use of laser etching. The shaping of the interior surface may be arrived at by using known mathematical techniques and computer modeling to design the precursor surface taking into account the velocity and temperature and density of the fluid being conducted.

It is preferred that the injector nozzle be made such that during operation the second frequency is reached substantially contemporaneously with the initial formation of the deposits. For most internal combustion engine injectors, it is preferred that as the injector cokes, the injector fluid reaches the second frequency within 4 hours of continuous operation, and most preferably within 1 hour of continuous operation. It is also preferred that the injector during operation results in less than ½% flow loss.

Another embodiment provided herein includes a method of producing an injector nozzle for an internal combustion engine having anti-deposit characteristics, the method comprising the steps: (a) obtaining an injector nozzle for an internal combustion engine, the injector nozzle comprising: (i) an injector nozzle seat portion and needle adapted to fit against the seat and adapted to be moved between a closed position against the seat and an open position away from contact with the seat; and (ii) an injector nozzle pipe portion having an entrance, an inside diameter at the entrance, an interior surface, and a degree of taper, the injector nozzle during operation of the internal combustion engine giving rise to a sonic shock wave of a frequency; and (b) altering any one or more of the following: (i) the dimensions of the injector nozzle seat portion and/or the needle, (ii) the inside diameter at the entrance, (iii) the degree of taper, and (iv) the interior surface of the injector nozzle pipe portion; and (c) determining the change in the sonic shock wave frequency brought about by step (b) to arrive at an altered sonic shock wave frequency such that, when fuel is passed through the injector nozzle during operation of the internal combustion engine, as or after deposits from the fuel begin to develop on the interior surface of the injector nozzle pipe portion during the operation, the sonic shock wave of the altered frequency causes the deposits to be removed.

The present disclosure also includes a method of removing deposits from fuel injector nozzles.

Some of the many advantages that may be achieved include maintaining deposit levels to regimes that can be more satisfactorily handled by fuel additives. This in turn reduces the costs of injector replacements under manufacturer's warranty.

DETAILED DESCRIPTION OF THE PREFERRED EMBODIMENT

Injector coking is a problem in both gasoline and diesel direct injected engines because of the harsh thermal and physical environment in which the injector nozzles have to operate; the troublesome deposit almost always grows from the outside in to the injector nozzle, and if not checked will extend all the way past the sealing band. Morphological studies of the nozzle deposit as it grows shows that it builds up in furrows orthogonal to the fluid flow direction. This would indicate temperature dependent deposit formation mechanism that follows the oscillating temperature gradients set up by the sonic shock wave created in the nozzle by the fluid being forced through it. As these deposit furrows grow with operational time, the dimensions of the nozzle are dynamically altered to an ever increasing tapering towards the exit hole. This tapering changes the tuning of the sonic wave until it enters that frequency regime where it begins to remove the deposit as shown in the FIG. 1.

Also provided herein is a method of making deposit-free injector nozzles by means of sonic tuning the flow through it so that the flow enters the self cleaning frequency regime as soon as the deposit begins to layer down at the nozzle exit end. Knowing the flow rates expected and the pressure propelling the flow, one may design a nozzle orifice that is self cleaning by judiciously balancing: 1) the seat and needle dimensions, with 2) the l/d, and 3) the tapering of the nozzle pipe, such that the self cleaning sonic frequency regime is entered as soon as nozzle coking begins.

Figure 1:
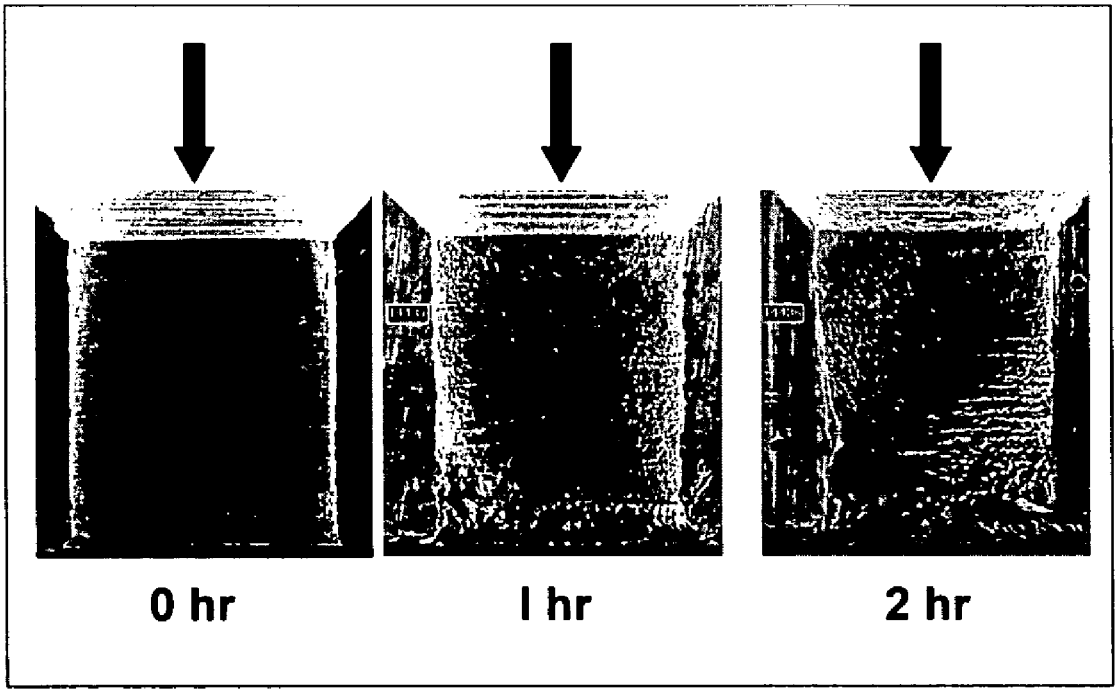
FIG. 1 shows a photomicrograph of deposit growth and removal mechanisms in fuel direct injectors by sonic shock waves.

FIG. 1 demonstrates one embodiment of this concept. The fluid flow direction through the injector nozzle is shown with the arrows. Coking mechanisms of this design injector were studied in a direct injection spark-ignition (DISI) engine. As can be seen after one hour operation, the deposit is growing countercurrent to the flow, and in furrows orthogonal to the flow. Since the combustion event is occurring in the combustion chamber located at the bottom of the nozzle face as drawn in the Figure, the resultant temperature gradient set up on the injector decreases countercurrent to the flow through the nozzle. It is this temperature gradient that is responsible for the deposit amount build up profile with the highest amounts at the nozzle exit, decreasing towards the nozzle interior following the decreasing temperature gradient. The orthogonal furrows are due to even steeper temperature oscillations following the amplitudes of the sonic shockwave set up by the flow. These furrows are evident in the nozzle picture taken after 1 hour operation, and even more pronounced in the 2 hour image. The 1 hour image also shows onset of a pitting in the vicinity of the nozzle exit indicating the onset of the sonic cleaning mechanism. This mechanism would be expected to be initiated as the dimensions of the nozzle hole are altered by the deposit thus tuning the sonic frequency of the shockwave set up by the flow into a frequency that effects cleaning.

Figure 2:
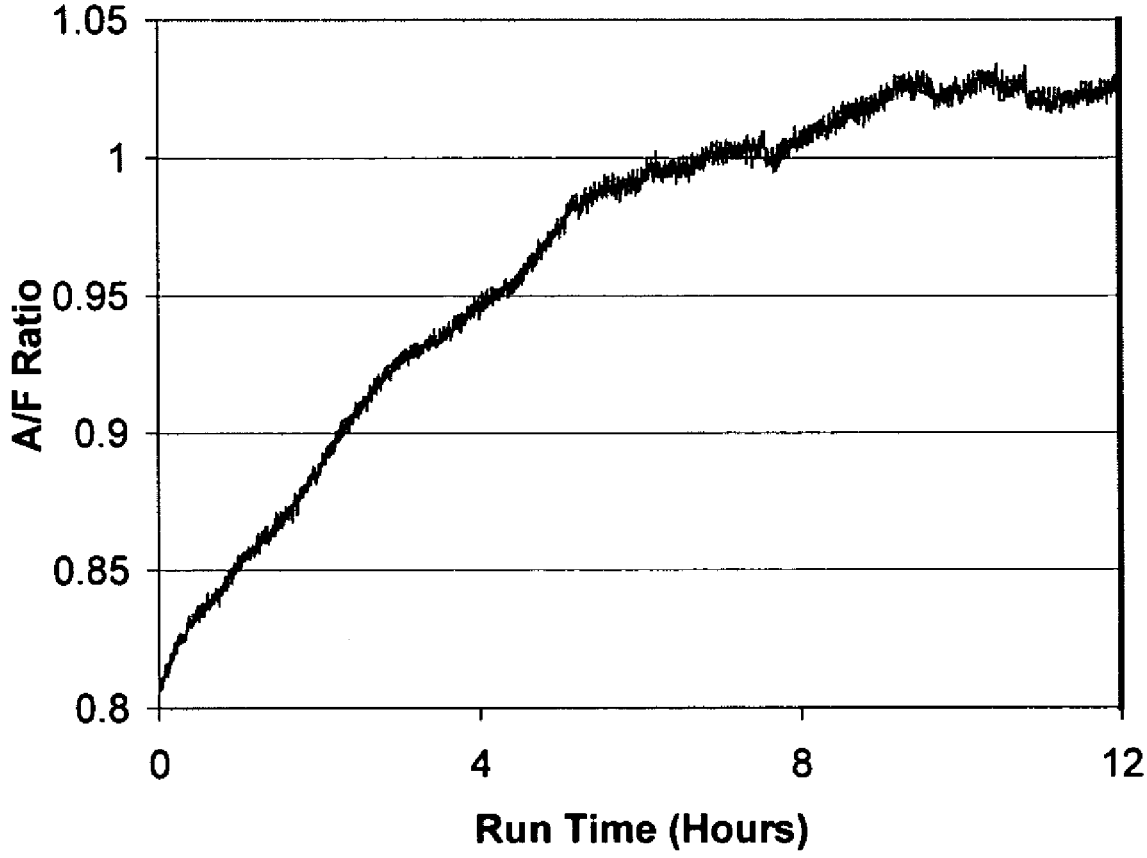
FIG. 2 shows a graph of A/F Ratio vs. Run Time to demonstrate deposit growth tuning of sonic shock wave through injector nozzle to a frequency regime that initiates the deposit removal mechanism.

FIG. 2 verifies this mechanistic explanation. The results in that Figure show the effect of coking on flow through the nozzle by recording the air fuel ratio change due to flow restriction. The details to this method of injector coking has been published (Aradi et al. SAE 1999-01-3690, hereby incorporated herein by reference).

The decrease in slope in FIG. 2 is indicative of the onset of the injector nozzle self cleaning mechanism, working against the deposit formation mechanism. As the self cleaning mechanism becomes more developed, it is able to counterbalance the deposit formation mechanism, hence the leveling off of the deposit build up process in the nozzle, as indicated in FIG. 2, after the 9 hour operation period. Judicious sonic tuning of the shock wave in the nozzle during the design stage would enable the cleaning mechanism to be fully developed much earlier during the time the injector is in operation.

In view of the present disclosure, it is apparent that it is possible to make many modifications to the above described embodiments without departing from the spirit and scope of the present disclosure. Thus, the present disclosure is not limited by the foregoing description. Rather it is set forth by the claims appended hereto.

What is claimed is:

1. An injector nozzle for an internal combustion engine having anti-deposit characteristics, said injector nozzle comprising:

(a) an injector nozzle seat portion and needle adapted to fit against said seat and adapted to be moved between a closed position against said seat and an open position away from contact with said seat;

(b) an injector nozzle pipe portion having an entrance, an inside diameter at said entrance, an interior surface, and a degree of taper;

said injector nozzle having an injector nozzle seat portion and needle of such dimensions, an inside diameter at said entrance, and a degree of taper such that, when fuel is passed through said injector nozzle during operation of said internal combustion engine, a sonic shock wave is created within said injector nozzle pipe portion, and as deposits from said fuel begin to develop on said interior surface of said injector nozzle pipe portion during said operation, the frequency of said sonic shock wave changes from a first frequency at which said sonic shock wave does not cause said deposits to be removed, to a second frequency at which said sonic shock wave causes said deposits to be removed.

2. An injector nozzle according to claim 1 wherein the rate at which said deposits are removed upon said shock wave reaching said second frequency is at least equal to the rate at which said deposits are deposited.

3. An injector nozzle according to claim 1 wherein said injector nozzle seat portion tapers from a diameter greater than said inside diameter at said entrance of injector nozzle pipe to a diameter less or equal to said inside diameter at said entrance of injector nozzle pipe.

4. An injector nozzle according to claim 1 wherein said injector nozzle seat portion comprises a curved portion and wherein said needle comprises a contact portion of even greater curvature, said contact portions adapted to engage one another when said needle moves to said closed position.

5. An injector nozzle according to claim 1 wherein said injector nozzle seat portion comprises a flat portion and wherein said needle comprises a curved portion, said flat portion and said curved portion adapted to engage one another when said needle moves to said closed position.

6. An injector nozzle according to claim 1 wherein said interior surface of said injector nozzle pipe portion comprises furrows aligned orthogonal to the direction of flow of said fuel during said operation.

7. An injector nozzle according to claim 1 wherein said interior surface of said injector nozzle pipe portion comprises dimple-shaped protrusions.

8. An injector nozzle according to claim 1 wherein said injector nozzle during operation results in less than ½% flow *loss*.

9. An injector nozzle according to claim 1 wherein said injector nozzle during operation reaches said second frequency substantially contemporaneously with the initial formation of said deposits.

10. An injector nozzle according to claim 1 wherein said injector nozzle during operation reaches said second frequency within 4 hours of continuous operation.

11. An injector nozzle according to claim 1 wherein said injector nozzle during operation reaches said second frequency within 1 hour of continuous operation.

12. A method of producing an injector nozzle for an internal combustion engine having anti-deposit characteristics, said method comprising the steps:

(a) obtaining an injector nozzle for an internal combustion engine, said injector nozzle comprising: (i) an injector nozzle seat portion and needle adapted to fit against said seat and adapted to be moved between a closed position against said seat and an open position away from contact with said seat; and (ii) an injector nozzle pipe portion having an entrance, an inside diameter at said entrance, an interior surface, and a degree of taper, said injector nozzle during operation of said internal combustion engine giving rise to a sonic shock wave of a frequency; and (b) altering any one or more of the following: (i) the dimensions of said injector nozzle seat portion and/or said needle, (ii) the inside diameter at said entrance, (iii) the degree of taper, and (iv) the interior surface of said injector nozzle pipe portion; and (c) determining the change in said sonic shock wave frequency brought about by step (b) to arrive at an altered sonic shock wave frequency such that, when fuel is passed through said injector nozzle during operation of said internal combustion engine, as deposits from said fuel begin to develop on said interior surface of said injector nozzle pipe portion during said operation, said sonic shock wave of said altered frequency causes said deposits to be removed.

13. A method according to claim 1 wherein steps (b) and (c) are repeated until injector nozzle during operation results in less than ½% flow *loss*.

14. A method of removing deposits from a fuel injector, said method comprising the steps:

(a) providing an injector nozzle seat portion and needle adapted to fit against said seat and adapted to be moved between a closed position against said seat and an open position away from contact with said seat; and (b) an injector nozzle pipe portion having an entrance, an inside diameter at said entrance, an interior surface bearing deposits, and a degree of taper; said injector nozzle having an injector nozzle seat portion and needle of such dimensions, an inside diameter at said entrance, and a degree of taper such that, when fuel is passed through said injector nozzle during operation of said internal combustion engine, a sonic shock wave is created within said injector nozzle pipe portion, and as deposits from said fuel begin to develop on said interior surface of said injector nozzle pipe portion during said operation, the frequency of said sonic shock wave frequency changes from a first frequency at which said sonic shock wave does not cause said deposits to be removed, to a second frequency at which said sonic shock wave causes said deposits to be removed, and (b) conducting a liquid or gaseous fuel through said injector nozzle pipe portion at sufficient velocity that said deposits are first deposited upon said injector nozzle pipe portion and subsequently removed by sonic shock created within said injector nozzle pipe portion.

15. A liquid or gaseous fluid conduit having anti-deposit characteristics under its operating conditions, said liquid or gaseous fluid conduit carrying a liquid or gaseous fluid that contains materials that become deposited on said conduit comprising:

a liquid or gaseous fluid conduit having adapted to carry a liquid or gaseous fluid at hypersonic speeds, said and liquid or gaseous fluid containing materials that become deposited under the operating conditions of said conduit; said liquid or gaseous fluid conduit having an interior surface such that, when said liquid or gaseous fluid is passed through said liquid or gaseous fluid conduit during operation, a sonic shock wave is created within said liquid or gaseous fluid conduit, and as or after deposits from said liquid or gaseous fluid begin to develop on said interior surface of said liquid or gaseous fluid conduit, the frequency of said sonic shock wave frequency changes from a first frequency at which said sonic shock wave does not cause said deposits to be removed, to a second frequency at which said sonic shock wave causes said deposits to be removed.

16. A liquid or gaseous fluid conduit according to claim 15 wherein the rate at which said deposits are removed upon said shock wave reaching said second frequency is at least equal to the rate at which said deposits are deposited.

17. A liquid or gaseous fluid conduit according to claim 15 wherein said gaseous fluid conduit during operation reaches said second frequency substantially contemporaneously with the initial formation of said deposits.

18. A liquid or gaseous fluid conduit according to claim 15 wherein said gaseous fluid conduit during operation reaches said second frequency within 4 hours of continuous operation.

19. A liquid or gaseous fluid conduit according to claim 15 wherein said gaseous fluid conduit during operation reaches said second frequency within 1 hour of continuous operation.

20. A method of producing a liquid or gaseous fluid conduit having anti-deposit characteristics under its operating conditions, said liquid or gaseous fluid conduit carrying a liquid or gaseous fluid that contains materials that become deposited on an interior surface of said conduit, said method comprising the steps:

(a) obtaining a liquid or gaseous fluid conduit having an entrance, an inside diameter at said entrance, an interior surface, and a degree of taper, said injector nozzle during operation of said internal combustion engine giving rise to a sonic shock wave of a frequency; and (b) altering any one or more of the following: (i) the inside diameter at said entrance, (ii) the degree of taper, and (iii) the interior surface of said liquid or gaseous fluid conduit; and (c) determining the change in said sonic shock wave frequency brought about by step (b) to arrive at an altered sonic shock wave frequency such that, when fuel is passed through said injector nozzle during operation of said internal combustion engine, as deposits from said liquid or gaseous fluid begin to develop on said interior surface of said liquid or gaseous fluid conduit during said operation, said sonic shock wave of said altered frequency causes said deposits to be removed.

* * * * *